United States Patent [19]

Sahm

[11] Patent Number: 4,869,507

[45] Date of Patent: Sep. 26, 1989

[54] GOLF CLUB

[75] Inventor: Douglas Sahm, Encinitas, Calif.

[73] Assignee: Players Golf, Inc., Rancho Santa Fe, Calif.

[21] Appl. No.: 66,657

[22] Filed: Jun. 25, 1987

Related U.S. Application Data

[63] Continuation-in-part of Ser. No. 874,682, Jun. 16, 1986, Pat. No. 4,754,977.

[51] Int. Cl.[4] ..... A63B 53/04

[52] U.S. Cl. ..... 273/171; 273/167 H

[58] Field of Search ..... 273/171, 167 F, 80 R, 273/167 A, 172, 169, 170, 173, 174, 175, 167 H, 168

[56] References Cited

U.S. PATENT DOCUMENTS

| | | | |
|---|---|---|---|
| 1,133,129 | 3/1915 | Govan | 273/171 |
| 1,840,924 | 1/1932 | Tucker | 273/171 |
| 2,067,556 | 1/1937 | Wettlaufer | 273/171 X |
| 2,361,415 | 10/1944 | Reach | 273/80 R |
| 3,556,533 | 1/1971 | Hollis | 273/171 |
| 3,582,081 | 6/1971 | Caplan | 273/171 |
| 3,995,865 | 12/1976 | Cochran et al. | 273/171 |
| 4,325,553 | 4/1982 | Taylor | 273/167 F |
| 4,423,874 | 1/1984 | Stuff | 273/171 |
| 4,754,977 | 7/1988 | Sahm | 273/167 A |

FOREIGN PATENT DOCUMENTS

| | | | |
|---|---|---|---|
| 440379 | 12/1935 | United Kingdom | 273/171 |
| 2145629 | 3/1985 | United Kingdom | 273/171 |

*Primary Examiner*—George J. Marlo
*Attorney, Agent, or Firm*—James C. Wray

[57] ABSTRACT

A weighting system for wood golf club heads comprising first, second and third weight receiving sockets and at least one set of removable and interchangeable weights receivable in the sockets. The first and third sockets are disposed in the heel and toe portions of the club head with axes substantially parallel to the face portion. The second socket is disposed between the first and third sockets, with a longitudinal axis substantially perpendicular to the face portion of the club head. The weights are made of materials of varying density. Weighting changes can easily be effected by removing an existing set of weights and replacing them with a set made of greater or lesser density material. Preferably, the weights are screw-threaded into the sockets.

4 Claims, 3 Drawing Sheets

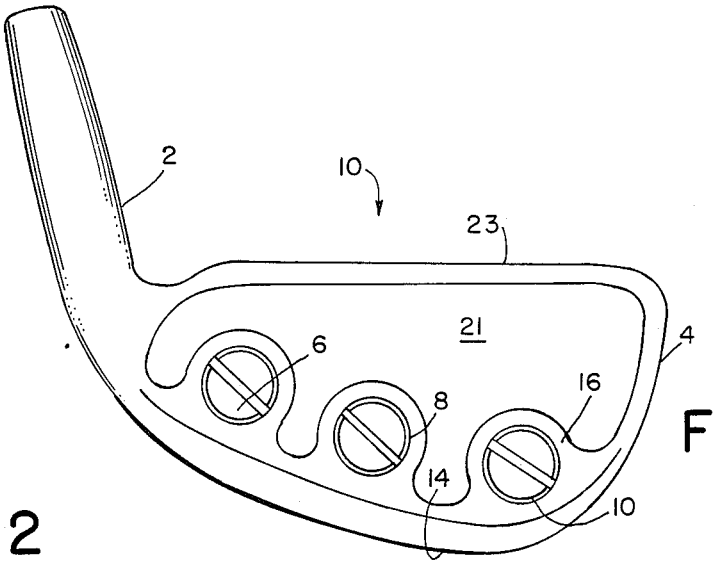
FIG. 1
FIG. 2
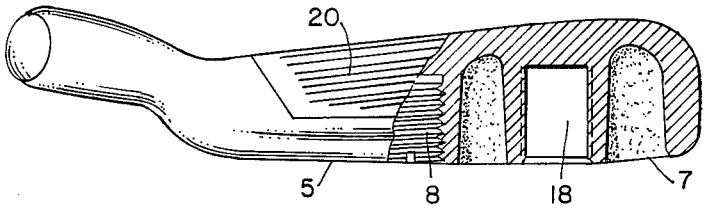
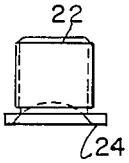
FIG. 4
FIG. 5
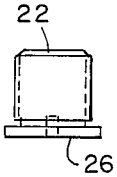
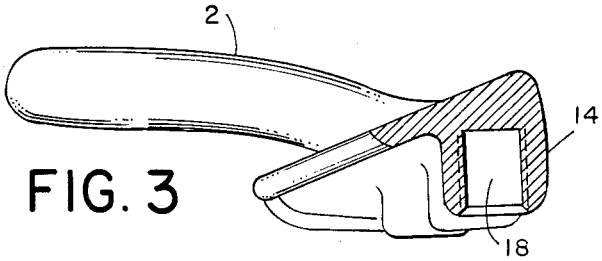
FIG. 3
FIG. 13
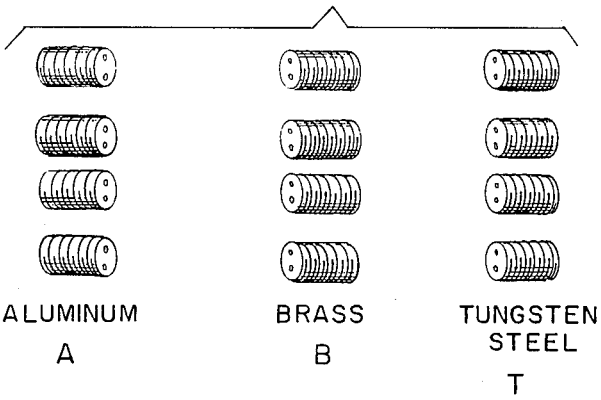

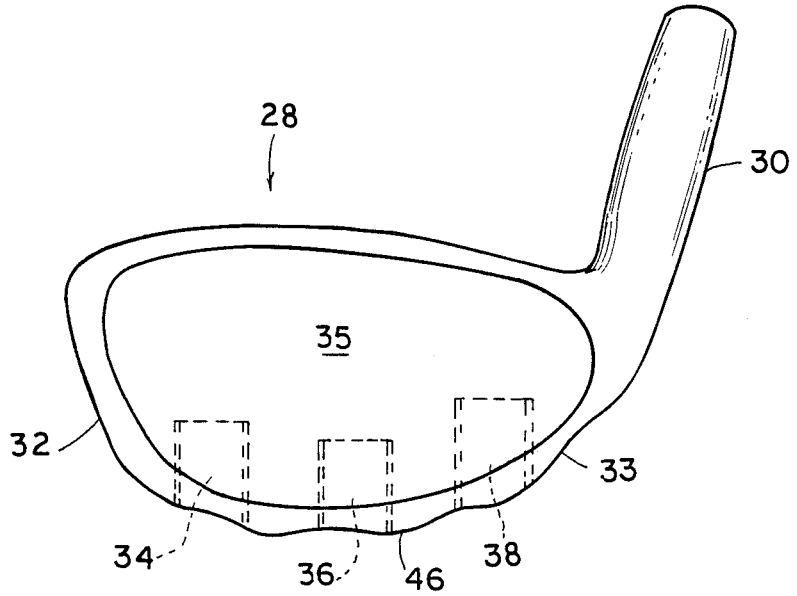
FIG. 6
FIG. 7
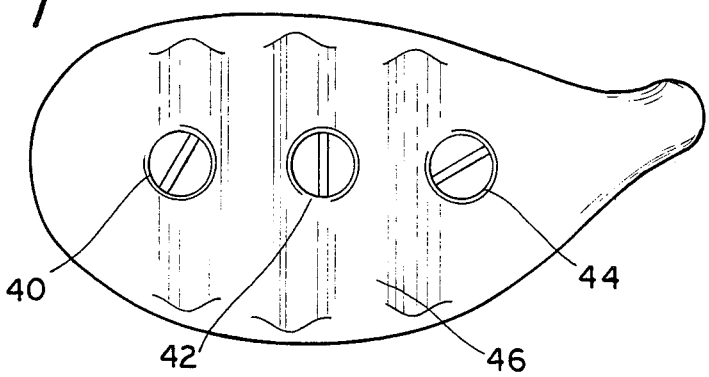
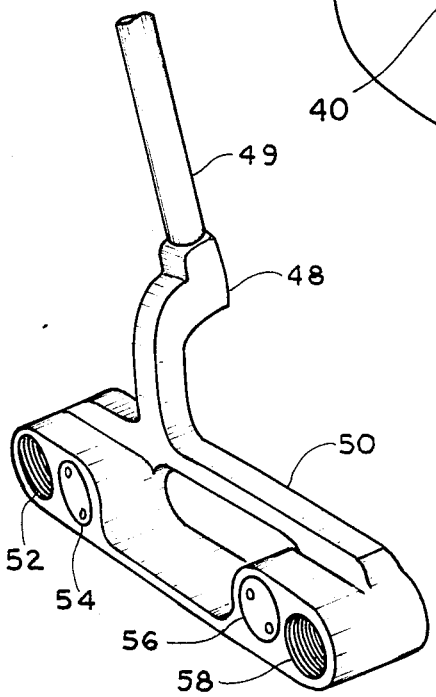
FIG. 8
FIG. 12
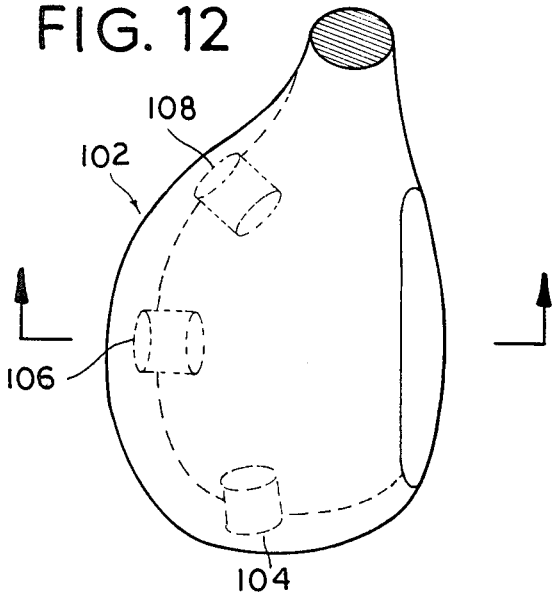

GOLF CLUB

This is a continuation-in-part of application Ser. No. 874,682 filed June 16, 1986, now U.S. Pat. No. 4,754,977.

BACKGROUND OF THE INVENTION

The present invention relates generally to sporting equipment and more specifically to the sport of golf.

Golf clubs have for many years been characterized as having hosel, heel, toe, face and flange portions. The hosel is generally a receptacle for receiving the club shaft and a support for generally supporting the club head on the end of the shaft. While one end of the hosel receives the club shaft, the other is integrally formed with the club head.

The club face is generally inclined at an angle depending on the required loft of the shot, and the sole is a generally continuous surface on which the club rests prior to swinging the golf club.

Over the years, improvements in club design have focused on broadening the flange, the purpose of which was to lower the center of gravity of the club head which in turn would add more loft to a golf shot. It was believed that the broadened flange would also allow the golfer to add more loft to his or her shots since more weight would be passing under the ball at impact.

Some golf club manufacturers provide permanent weights in club heads to customize the club with respect to an individual's golf swing. In some instances, these permanent weights are provided in the heel and toe portions of the club in an attempt to minimize the torque effect created by impacts at points other than the "sweet spot". The "sweet spot" is defined as the point in a body free to move about a fixed axis, at which the body may be squarely struck without jarring the axis.

Problems persist in the art. An individual's golf swing may vary slightly or dramatically from week to week. While variances may occur, the golfer is limited to the permanent weighting of his or her clubs which were selected based on his or her swing at a given point in time. Moreover, a set of clubs customized for one golfer will not be suitable for another. The strength of a golfer may have profound effects on his or her swing. As strength changes, weighting of the club should also change.

SUMMARY OF THE INVENTION

The present invention solves many of the problems associated with the art of providing removable and interchangeable weights that can not only customize and optimize the weighting of a club for a given golfer, but can also allow the golfer to change weighting as his swing changes or as his strength changes.

The focus of the invention is on providing removable weights. One set of weights may be made of brass, while another set may be made of plastic, such that lighter or heavier weights can be used according to the needs of the golfer. Conceivably, an entire spectrum of weights could be used ranging from light to heavy with gradations there between. Preferably, tungsten would provide a heavy weight, while aluminum or plastic would provide a light weight. Intermediate weights of other suitable materials may be used to provide a gradual increment in density and therefore weighting.

Generally, a set of aluminum weights could be substituted for a set of brass or other metal weights. In a preferred embodiment, the weights number three, with one in each the toe and heel portions, and one between them. While whole sets of three weights may be exchanged, it is possible to mix sets such that, for instance, light weights may be used in the heel and toe which a heavier weight may be used in the middle.

Uniquely, the present invention makes it possible to accent the weight distribution to favor the toe, center or heel of the club head. Many players find it to their advantage to emphasize toe weighting for the long irons and heel weighting for the short irons. This invention not only makes this customizing possible but it also makes it possible to vary the degree. This is achieved by hollowing out the back side of the club opposite the face and above the flange, and integrally forming three sockets immediately above the flange.

For irons, it is preferable to have the sockets disposed in line with the direction of the club swing, or in other words, in line with the intended flight direction of the ball.

This invention also contemplates use for golf putters, wherein the disposition of the sockets is similar to that of the irons, except that the sockets are approximately at a longitudinal axis of the club face and not at the flange.

An object of the invention is to provide a golf club apparatus having integrally formed hosel, heel, toe, face and flange portions, and weighting means, the weighting means comprising removable and interchangeable weighting means.

In a preferred embodiment, the weight means comprises weight receptacle means removable weights receivable in the weight receptacle means.

In another embodiment, the weight receptacle means are disposed above the flange portion and opposite the face portion.

In another embodiment, the weight receptacle means comprise sockets integrally formed with the flange portion opposite the face portion.

In another embodiment, there are three sockets with one being disposed in the heel and toe portions respectively and one socket being disposed between the heel and toe portions.

In another embodiment, the invention further comprises fastening means for fastening the weights within the weight receptacle means.

In another embodiment, the weight receptacle means comprise sockets integrally formed with the flange portion opposite the face portion and the fastening means comprise tapped bores of the sockets meshing with threads provided on outer surfaces of the weights.

In another embodiment, the invention comprises means for removing and inserting weights.

In another embodiment, the means for removing and inserting comprises grooves provided in head portions of the weights.

In another embodiment, the sockets are three sockets, one being disposed in the heel and toe portions respectively and one being disposed between the heel and toe portions, and wherein longitudinal axes of the sockets are disposed in line with a swing direction of the club and are approximately aligned.

In another embodiment, the sockets have an outer peripheral edge coextensive with an outer edge of the flange portion.

In another embodiment, a back portion of the club opposite the face and above the flange portions is hollowed and wherein portions between the sockets are hollowed, wherein the hollowed portion provides for weight focus in an area of the sockets.

In another embodiment, the weights comprise plural sets of weights, each set being made of a material having a mass different from the material of the other sets.

In another embodiment, each set of weights comprises three weights, each being provided with threads engageable with threads provided in the weight receptacle.

In another embodiment, the material used in fabricating each set of weights is selected from a group consisting of brass, steel, stainless steel, tungsten and aluminum.

In another embodiment, the invention comprises a weighting system for clubs having hosel, heel, toe, face and flange portions. The weighting system comprising, weight receiving sockets and removable and interchangeable weights receivable in the sockets.

In another embodiment, the weights have screw-threaded outer surfaces engageable with screw threaded inner surfaces of the sockets, and wherein the weights have grooves provided in headed portions thereof, each weight having the same density as the other weights.

In another embodiment, three weights comprise a set, each set being interchangeable with sets having varying density.

In another embodiment, the sockets are disposed with longitudinal axes in a swing direction of the club.

In another embodiment, the sockets are disposed with longitudinal axes perpendicular to a swing direction of the club.

In another embodiment, the sockets are disposed at the flange portion, and wherein the club is hollowed between the sockets and opposite the face portion.

In another embodiment, the sockets extend into the flange portion.

In another embodiment, the sockets are disposed opposite the face portion approximately at a longitudinal axis of the face portion.

In another embodiment, the invention comprises a method for adjusting the weighting of a golf club having hosel, heel, toe, face and flange portions. The method comprises removing weights from sockets disposed opposite the face portion and substituting weights having a different density from the removed weights, and further substituting weights of different density until club weighting is optimized for an individual golfer.

In another embodiment, the invention comprises forming a club head with hollowed portions opposite the face portion and above the flange portion and between the sockets, thereby focusing weight at the sockets.

The present invention is also manifest in a weighting system for golf clubs in which a golf club head can be weighted to compensate for natural tendencies and propensities for a golfer's swing to generate slice or hook spin on a golf ball. Deviation from a straight ball path is caused by non-perpendicular club face alignment at impact in combination with club head path at the same instant.

In addition to removable weights, the weighting system of the present invention provides means for lowering the center of gravity and broadening the sweet spot. This results in better loft for each shot and less likelihood of mis-hitting the ball.

Swing weight and weight dispersal are two of the most important aspects of a golf club. The present invention uses three different weights which can be installed in eleven different combinations, each combination being suitable to a particular golf swing.

The club head of the present invention has a swing weight of B8, with no weights installed in the sockets. Three sets of weights, made of anodized aluminum, brass and tungsten steel, are given values of one, five and ten swing weight points, respectively. The preferred weighting system provides means for varying the swing weight from C1 to D4. C1 would involve the installation of three one-point aluminum weights, which changes the empty weight of B8 to C1. Depending on weight combination, a golfer can compensate for natural tendencies to hook or slice inherent in the individual's swing. For golfers without need for compensation, the system provides means to add distance to each shot by allowing optimal adjustment of swing weight.

A special tool is provided in one embodiment so that weights can easily be changed by the golfer. The preferred tool has a two-prong end face with the prongs insertable into bores provided in an outer surface of each weight. The tool can be used to tighten the weights periodically, if necessary. Glue may be used to prevent accidental loosening, but the glue would not prevent loosening with the tool.

A preferred system would provide the golfer with three (3) one point anodized aluminum weights, two (2) fine point brass weights, and one (1) ten point tungsten steel weight for each wood and iron.

The following are preferred weighting combinations for irons to achieve different swing types:

A=anodized aluminum
B=brass
T=tunsten steel
Light weight (for seniors, juniors, and ladies):
AAA=C1 (all types)
Regular weight:
BAB=C9 (forgiving toe and heel)
ATA=D0 (distance club)
TAA=D0 (slicer's club)
AAB=D0 (hooker's club)
Medium weight:
ABA=C5 (distance club)
BAA=C5 (slicer's club)
AAB=C5 (hooker's club)
Heavy weight (for very strong players): recommended shaft types R, S and K
BBB=D3 (distance club)
TBA=D4 (slicer's club)
ABT=D4 (hooker's club)

Generally for irons, a regular weighting is for a player who hits a 5 iron over 150 yards and under 175 yards. A medium weight is for a 150 year 5 iron. Heavy weight is for a 5 iron greater than 175 yards.

A preferred wood would have three sockets extending inwardly from heel and toe areas of the wood and from a middle area, all of which are disposed behind the club face.

Lightweight woods would have a combination AAA for senior, ladies and juniors.

The wood clubs are equipped with three (3) weights, which may be of various densities. One weight is installed at the back of the club head with its axis perpendicular to the face of the club. The other two weights are located at the heel and toe with their axis nearly parallel to the club face. The weights may be varying densities so that the overall weight (and the related swing weight) may be changed and also the mass distribution in the club head can be redistributed to favor the heel or toe in order to suit the individual player.

Regular weighted woods could have the following combinations:

ATA=D0 (distance club)
TAA=D0 (slicer's club)
AAT=D0 (hooker's club)

It is understood that reading the letter combination is from heel to toe, so that "AAT" would require "A" in the heel, "A" in the middle, and "T" in the toe, and for the regular weighted wood, this arrangement would be corrective for a natural "hook" tendency.

Preferred putters are provided with four sockets for weights. Putter weights can be selected from those not used in the woods and irons; weight selection is a function of individual "feel" as opposed to swing weight since putting involves an abbreviated stroke instead of a full swing.

The letters listed above are read from heel to toe so that in a club having three sockets, one in the heel, one in the toe and one in between, "ABA" would mean aluminum weight in the heel, brass in the middle and aluminum in the toe.

BRIEF DESCRIPTION OF THE DRAWINGS

FIG. 1 is a rear plan view of one embodiment of the invention.

FIG. 2 is a top plan view, partly in section, of the embodiment of FIG. 1.

FIG. 3 is a side plan view, partly in section, of the embodiment of FIG. 1.

FIGS. 4 and 5 are side views of two weights used in all embodiments of the invention.

FIG. 6 is a front plan view of another embodiment of the invention.

FIG. 7 is a bottom plan view of the embodiment of FIG. 6.

FIG. 8 is a rear perspective view of another embodiment of the invention.

FIG. 12 is a top plan view of the FIG. 11 embodiment.

FIG. 13 shows sets of varied weights.

DETAILED DESCRIPTION OF THE DRAWINGS

Figure 9:
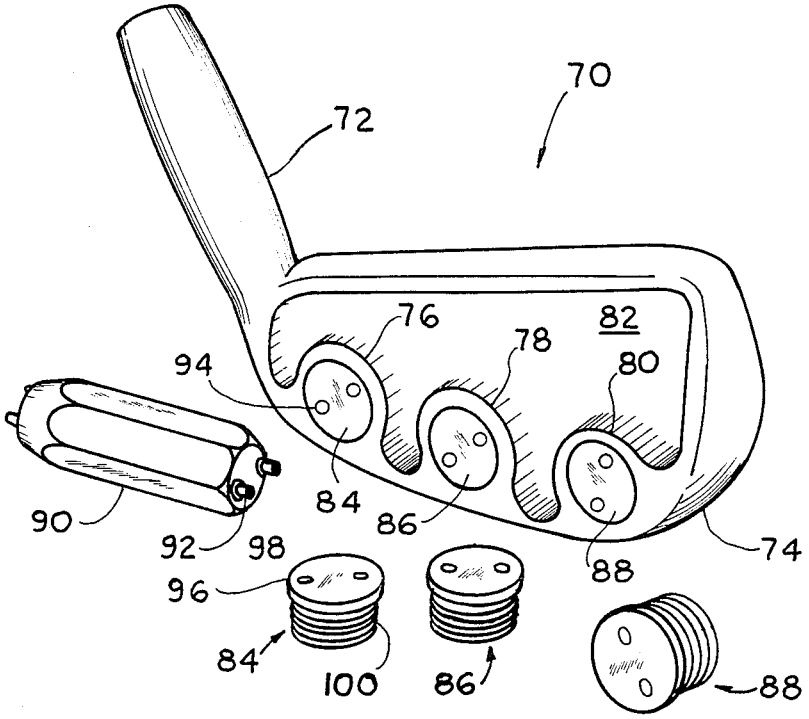
FIG. 9 is a perspective view of an iron with a preferred weight head configuration and tool for removing weights.

Referring now to FIGS. 1–5, a club head is generally referred to as numeral 10. The club head 10 is preferably cast metal having an integrally formed hosel portion 2, face portion 20, heel portion 5, toe portion 7, and flange portion 14. The hosel portion has one end for receiving a club shaft (not shown), while the other end is integral with one side of the club face. The opposite side of the club face is shown as numeral 4.

The weights 6, 8, 10 are provided opposite the face portion 20 and are receivable as integrally formed sockets 16. Each weight has a threaded outer surface 22 and a headed portion 26. Each bore 18 is tapped to provide threads engageable with the threads of the weights. The intermeshing threads provide fastening means for fastening the weights within the bores. Preferably, the headed portion is provided with a groove 24 that facilitates insertion and removal of the weights. The groove may have a width corresponding to a coin, such as a quarter or dime, such that the weights can be removed and inserted without special tools. The depth may be curved to correspond to a portion of the coin used to remove or insert the weights.

FIGS. 1–3 show an embodiment preferred for irons, in which the sockets 16 are disposed opposite the face portion 20 and show the flange portion 14. The area between the sockets 16 is hollowed out, as well as the area 21 above the sockets up to the upper edge 23 of the club head. The effect is to permit the weight distribution to be varied over the lateral axis of the club head to suit the particular requirements of the golfer with each different club in a set of clubs.

Weights shown in FIGS. 4 and 5 are of different density to illustrate how the invention works. A set of weights having the density of the FIG. 4 weight may be substituted for weights of FIG. 5 density. While having different density, the weights have the same diameters and thread patterns so that they are completely interchangeable.

For irons, the sockets preferably have an outer peripheral edge coextensive with an edge of flange 14, and have longitudinal axes aligned with the direction of the swing. In other embodiments, the socket positions are different.

FIGS. 6 and 7 relate to an embodiment for woods. The club head, generally referred to as 28, has a hosel portion 30, a flange or bottom 46, toe portion 32, heel portion 33 and face portion 35. Sockets 34, 36, 38 extend upwardly from the bottom into the club head, which may be made of wood or metal. Weights 40, 42, 44 are secured in the bores of the sockets by threads or other suitable means.

FIG. 8 shows an embodiment of the invention for putters. The putter has a hosel portion 48 and a face portion 50. The face is substantially vertical and the weights 52, 54, 56, 58 are disposed opposite the club face in bores. Other numbers of weights may be used in symmetrical patterns to ensure balance. Weights of different density may be used to fit individual needs. A shaft 49 is shown coming into hosel 48.

Referring to FIG. 9, a club head 70 for an iron has hosel 72 or heel portion and toe portion 74 and three sockets 76, 78, 80. A hollowed area 82 is opposite the club face. Each socket receives weights 84, 86, 88 which are removed and inserted with tool 90 having two prongs 92 which are received in mating holes 94 provided in each weight.

Each weight has a head 96 and threaded portions 100. Tool 90 may have a single prong on the opposite end for rapid rotation of the weights.

Figure 10:
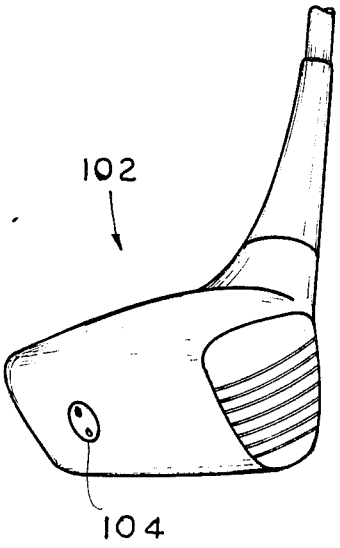
FIG. 10 is a perspective view of a preferred wood using weights similar to those shown in FIG. 9.
Figure 11:
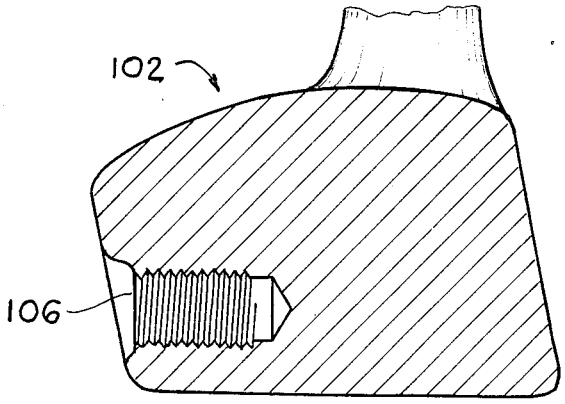
FIG. 11 is a cross sectional view of the preferred embodiment of wood.

FIGS. 10 and 11 show a wood in which three weights would be provided around the periphery in substantially the heel, middle and toe areas of the club head 102. A toe socket and weight 104 is shown in FIG. 10 and a middle socket 106 is shown in FIG. 11.

FIG. 12 shows a top view of the preferred wood head 102 with sockets 104, 106, 108 which receive weights in a similar manner to the irons. The "woods" could be made of conventional wood material or could be made of metal.

FIG. 13 shows sets of weights made of aluminum, brass and tungsten steel. Weight values are assigned to the weights so that aluminum (A)=1, brass (B)=5, and tungsten steel (T)=10. The weight values are related to the relative densities of the weights. Arranging a relatively heavier weight in between relatively lighter equally weighted heel and toe weights provides optimal distance for a given swing weight. Arranging the weights from heel to toe A, A, A, (A=aluminum) achieves a swing weight of light weight. Arranging the weights from heel to toe B, A, A, (B=brass) achieves a swing weight of regular weight with a forgiving toe and heel. Arranging the weights from heel to toe A, T, A, (T=tungsten steel) achieves a swing weight of a regular weight for maximum distance. Arranging the weights from heel to toe T, A, A, achieves a swing weight of a regular weight corrective for slice swings. Arranging the weights from heel to toe A, A, B, achieves a swing weight of a regular weight, corrective for a hook swing.

While the present invention has been described with respect to specific embodiments, modifications may be made without departing from the scope of the invention.

I claim:

1. A wood type golf club head having hosel, heel, toe and face portions, and a weighting system, the weighting system comprising:

first, second and third weight receiving sockets and at least one set of removable and interchangeable weights receivable in the sockets, wherein the first and third sockets being disposed in the heel and toe portions of the club head, respectively, and the second socket being disposed between the first and third sockets and wherein the weights have screw-threaded outer surfaces engageable with screw-threaded inner surfaces of the sockets, and wherein the weights have engageable indentations provided in head portions thereof, at least one socket being generally horizontally disposed with a longitudinal axis substantially parallel to the face portion of the club head, and at least one other socket being disposed with a longitudinal axis substantially perpendicular to the face portion of the club head.

2. The weighting system of claim 1 wherein three weights comprise a set, each set being interchangeable with sets having varying density.

3. The weighting system of claim 2 wherein the third socket is disposed in the toe portion with an axis substantially parallel to the face portion.

4. The weighting system of claim 1 wherein the second socket is disposed opposite the face portion approximately at a longitudinal axis of the face portion.

* * * * *